US005326575A

United States Patent [19]

Spaulding

[11] Patent Number: 5,326,575

[45] Date of Patent: Jul. 5, 1994

[54] BAG-IN-A-BAG WINDOW BAG ASSEMBLY WITH HIGH RESOLUTION CONTENT INDICIA

[75] Inventor: Scott Spaulding, Olathe, Kans.

[73] Assignee: Bagcraft Corporation of America, Chicago, Ill.

[21] Appl. No.: 887,954

[22] Filed: May 26, 1992

Related U.S. Application Data

[63] Continuation-in-part of Ser. No. 707,856, May 30, 1991, abandoned.

[51] Int. Cl.[5] ..... B65D 30/08; B65D 33/00; B65D 33/04

[52] U.S. Cl. ..... 426/87; 426/124; 426/383; 426/413; 206/459.5; 206/457; 383/106; 383/111; 229/162

[58] Field of Search ..... 426/106, 124, 87, 383; 383/106, 111, 127; 229/162; 206/459.5, 457; 53/411, 415, 449; 493/222, 905, 919, 925, 961; 220/662

[56] References Cited

U.S. PATENT DOCUMENTS

| | | | |
|---|---|---|---|
| 892,074 | 6/1908 | Obici | 426/124 |
| 1,814,967 | 7/1931 | Royal | 383/106 |
| 2,115,802 | 5/1938 | Dann | 383/106 |
| 2,209,200 | 7/1940 | Hanson | 229/162 |
| 2,245,185 | 6/1941 | Devble | 229/162 |
| 2,351,469 | 6/1944 | Allen | 229/162 |
| 2,703,043 | 3/1955 | Novick . | |
| 2,752,085 | 6/1956 | Bryce | 383/106 |
| 2,789,689 | 4/1957 | Lewis | 206/459 |
| 3,207,411 | 9/1965 | Farquhar | 229/162 |
| 3,312,337 | 4/1967 | Martin | 383/106 |
| 3,360,119 | 12/1967 | Mullinix | 229/162 |
| 3,389,850 | 6/1968 | Rockefeller | 229/162 |
| 3,885,731 | 5/1975 | Mullinix | 229/162 |
| 3,960,315 | 6/1976 | Dobbins | 229/162 |
| 4,097,611 | 6/1978 | Seiferth et al. | 229/162 |
| 4,202,450 | 5/1980 | Howell et al. . | |
| 4,979,833 | 12/1990 | Cook . | |
| 4,991,980 | 2/1991 | Cohen . | |

FOREIGN PATENT DOCUMENTS 819819 3/1962 United Kingdom .

OTHER PUBLICATIONS

Food Packaging Avi Publ. 1970, Sacharow et al pp. 366, 377–386, 389 404.

Food Engineering, p. 140.

*Primary Examiner*—Steven Weinstein

[57] ABSTRACT

There is disclosed herein a bag-in-a-bag system wherein the outer bag is windowed and content indicia is displayed in the window. In this system high resolution graphic indicia is provided for the content indicia and low resolution indicia, usually text, is provided on the bag. Furthermore, the graphic indicia is applied to a patch which underlays the window but is larger than the window and smaller than the window-carrying panel, usually the front panel. Furthermore, a protective adhesive liner is applied to the front panel and secures the patch in place. This layer is of a size larger than the patch and a out the size of the inside of the front panel. A method for making this bag-in-a-bag system is also disclosed.

3 Claims, 1 Drawing Sheet

BAG-IN-A-BAG WINDOW BAG ASSEMBLY WITH HIGH RESOLUTION CONTENT INDICIA

This application is a continuation-in-part of U.S. patent application Ser. No. 707,856 filed May 30, 1991, now abandoned.

BACKGROUND OF THE INVENTION

This invention relates to bags for carrying prepackaged items, and in particular, a bag-in-a-bag system which includes an aperture in the outer bag having high resolution content-indicating graphic indicia displayed in the aperture and having lower resolution text printed on the bag itself.

In U.S. application Ser. No. 707,856 which is commonly assigned, there is disclosed a bag-in-a-bag system for carrying contents wherein the contents of the inner bag is indicated in a window in the outer bag by a graphic layer appearing in the window.

However for manufacturing purposes it has become desirable to provide a more readily manufactured construction. As, for example, the graphic layer can have edges that catch on various parts of the machinery during the manufacturing operation.

Thus an object of this invention is to provide a more readily manufacturable system which eliminates the possible disadvantages of a prior system.

In connection with manufacturing the prior window bag, the graphic layer is substantially larger than the window aperture. As a result graphics may be positioned behind the bag panel, not at the window, are not visible, and thus perform no function.

Thus it is another object of this invention to provide a bag-in-a-bag system where the graphic indicia is principally in the window and non-visible graphics are minimized.

In windowed bag-in-a-bag systems the outer bag itself may be imprinted with text material and the layer in the window with the content-indicating graphic material. The use of low resolution printing techniques (such as rubber plate printing) may be suitable for the outer bag but are not suitable for the graphics because of the detail needed to graphically depict the bag contents. On the other hand, while the use of high resolution techniques may be suitable for the graphics they are not needed for the bag indicia, may be excessively costly, and are principally text-like.

Thus it is yet another object of this invention to provide a bag-in-a-bag system that employs a combination of printing techniques that provide suitable bag and graphic printing, which minimize costs and present an optimum combination for fabricating the outer bag for a bag-in-a-bag system.

These and other objects of this invention will become apparent from the following disclosure and appended claims.

SUMMARY OF THE INVENTION

This invention provides: a readily manufacturable windowed bag-in-a-bag system; a patch for minimizing graphic use and assuring application at the window; a liner system for ease in manufacturing and for reducing graphic catching and friction; and a system for using both high and low resolution printing techniques for the bag and graphics.

More specifically, there is provided by this invention an improved bag-in-a-bag system wherein the graphic layer or patch is larger than the window but smaller than the front panel so as to optimize the use of the graphic layer. A large adhesive-like web or liner which is larger than the graphic patch, can be smaller than the front panel, but may be as large as the front panel, forms a web that is secured to the front panel and holds the patch in position in the window.

Moreover, the patch is printed using high resolution techniques such as rotogravure so as to assure accurate depiction of the contents. High resolution is considered 160–200 line screen or greater. On the other hand, the outer bag itself can be printed using low resolution printing techniques such as rubber plate printing. Using this high/low resolution combination minimizes printing costs by using the printing techniques as appropriate for the application. For example, high resolution printing for the graphics and bag could be quite expensive and thus the use of the high/low resolution printing combination can minimize cost while still providing the desired appearance.

DESCRIPTION OF THE PREFERRED EMBODIMENT

Figure 1:
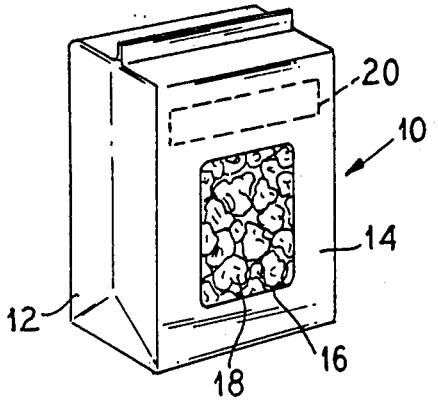
FIG. 1 is a perspective view of a bag-in-a-bag system where an inner content-carrying bag is positioned in an outer windowed bag having graphic indicia displayed at the window.
Figure 2:
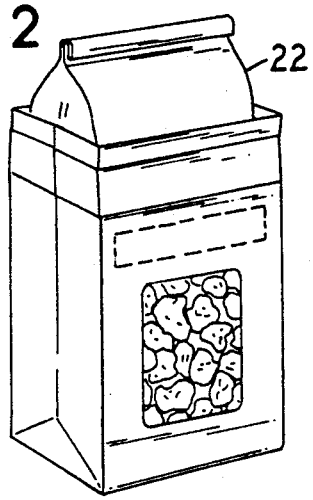
FIG. 2 shows the inner and outer bags.

Referring to FIG. 1, there is shown a bag-in-a-bag system 10 generally wherein the outer bag 12 is seen and has a front panel 14 in which a window aperture 16 is formed. Graphic indicia 18, which corresponds to the inner bag contents, is displayed at the window. Text type indicia 20 is printed on the bag itself.

The graphic indicia is printed using high resolution graphic techniques, such as steel cylinder rotogravure. Such printing is needed to duplicate the appearance of contents such as popcorn. High resolution is defined as at least 160–200 line screen. On the other hand, the bag is printed using low resolution techniques such as rubber plates since high resolution techniques are not needed. Low resolution techniques are defined as less than 160–200 line screen. This combination of high and low resolution minimizes cost significantly.

The inner bag 22 is a sealed opaque bag which carries contents which is usually food items such as popcorn.

The text 20 and graphics 18 correspond and relate to the contents so as to advise the viewer or shopper as to contents.

Figure 3:
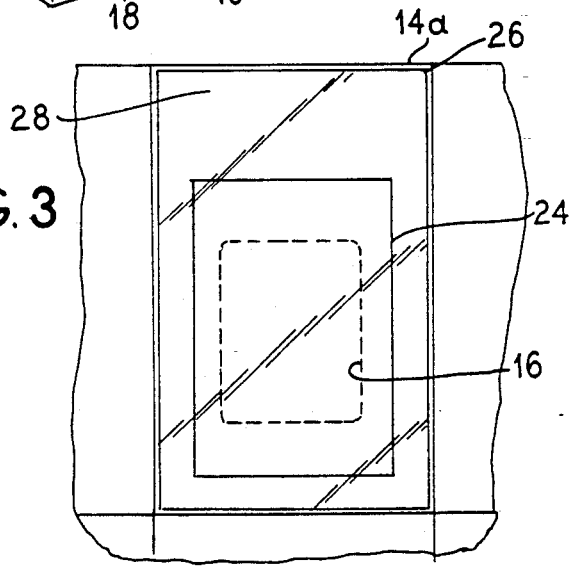
FIG. 3 is a plan view of the inside or back side of the window forming panel (usually the front panel) with a graphic patch and adherence liner in place.
Figure 4:
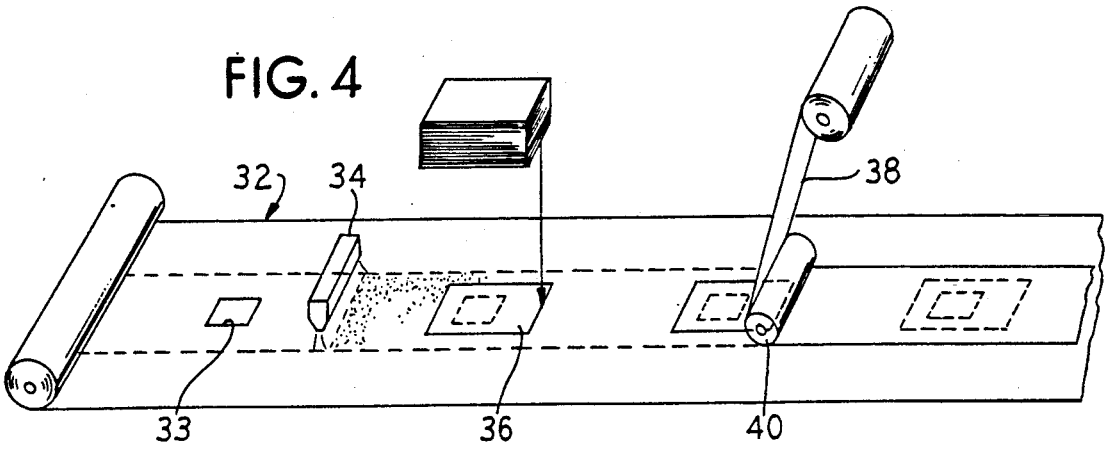
FIG. 4 shows a method for applying the graphic patch and layer to the bag-forming web for formation into a bag.

Referring to FIG. 3, a plan view of a fragment of the outer bag 12 showing the inside or back side **14*a* of the front panel 14 is shown. The window 16 is shown in dashed lines. A patch 24 on which the graphic indicia is printed is provided to rest against the panel and be displayed at the window. The patch 24 in a sense underlays the window 16**. Physically the patch is larger than the window but smaller than the front panel and can be secured, as by gluing along the peripheries, to the front panel.

A polyethylene layer or liner 26 which is moisture-proof is secured, preferably by use of an adhesive pattern, to the inside 14*a* of the front panel and holds the patch 24 in place. The layer is about the size of the front panel and can be held in place by a grid-like glue pattern 28.

There are several techniques for positioning and securing the liner and patch to the bag. In this embodiment standard bagmaking machinery is used to the greatest extent possible. The bag is apertured and in web form 32 and 33. Glue can be applied to the web as at station 34. Thereafter, a graphic patch, such as 36, can be applied to the web so as to cover, and thus underlay the window or aperture. After positioning the patch 36, a plastic liner 38, which may be a polyethylene film, is applied to the web 32, over the patch 36, and along the back or inside of the front panel. This liner can be adhesively secured to the web and pressed by a roller such as 40 into intimate contact with the adhesive, patch and web. Subsequently the lined and patched web can be formed into a bag.

Although the invention has been described with respect to preferred embodiments, it is not to be so limited as changes and modifications can be made which are within the full intended scope of the invention as defined by the appended claims.

I claim as may invention:

1. A bag-in-a-bag assembly comprising an inner opaque bag containing a product and an outer window-style bag containing said product containing inner opaque bag, said outer bag having a front panel which contains and defines a window-like aperture, and a graphic-style content indicia patch secured to the inner surface of said outer bag front panel so as to underlie said window-like aperture with said graphics being visible to a consumer through said window-like aperture;

said outer bag containing low resolution printed text indicia on its outer surface for generally indicating to the consumer the product contained inside said inner bag;

said graphic-style content indicia being high resolution printed indicia graphically depicting the product contained inside said inner bag and said indicia extending over at least the area of said window-like aperture such that the consumer sees through said window-like aperture, a picture that replicates the appearance of the product that is contained in the inner bag; and a liner adhesively secured to the inner surface of the front panel of the outer bag so as to underlie the window-like aperture and patch and secure the patch in position at the window-like aperture between the front panel and the liner and said patch being narrower than said front panel but at least as large as said window-like aperture and said liner being at least as wide as the front panel and being larger in size than said patch so as to totally enclose the perimeter of said patch within the perimeter of said liner secured to said inner surface of said front panel.

2. A bag assembly as in claim 1, wherein the graphic carrying patch is larger than the window-like aperture and smaller than the front panel.

3. A bag assembly as in claim 2, wherein the liner is larger than the patch and about the same size as the front panel.

* * * * *